US008430666B1

(12) United States Patent
Clevenger et al.

(10) Patent No.: US 8,430,666 B1
(45) Date of Patent: Apr. 30, 2013

(54) LOW PRESSURE HEATER CONTROL SYSTEM

(75) Inventors: Stacy Clevenger, Bowling Green, KY (US); Craig Higginbotham, Bowling Green, KY (US); Eric Pitchford, Bowling Green, KY (US); Joseph Lee, Bowling Green, KY (US)

(73) Assignee: Procom Heating, Inc., Brea, CA (US)

( * ) Notice: Subject to any disclaimer, the term of this patent is extended or adjusted under 35 U.S.C. 154(b) by 705 days.

(21) Appl. No.: 12/500,424

(22) Filed: Jul. 9, 2009
(Under 37 CFR 1.47)

Related U.S. Application Data

(60) Provisional application No. 61/079,614, filed on Jul. 10, 2008.

(51) Int. Cl.
*F23N 5/08* (2006.01)

(52) U.S. Cl.
USPC ..... 431/79; 340/578; 431/12; 431/13; 356/218; 356/434

(58) Field of Classification Search ..... 431/79; 340/583; 356/218, 434; 374/17, 19, 161; 377/53; 700/274
See application file for complete search history.

(56) References Cited

U.S. PATENT DOCUMENTS

| | | | | |
|---|---|---|---|---|
| 4,340,362 | A * | 7/1982 | Chalupsky et al. | 432/222 |
| 5,368,471 | A * | 11/1994 | Kychakoff et al. | 431/12 |
| 7,280,891 | B2 * | 10/2007 | Chase et al. | 700/275 |
| 7,289,032 | B2 * | 10/2007 | Seguin et al. | 340/578 |
| 2007/0281260 | A1 * | 12/2007 | McLellan | 431/79 |

* cited by examiner

*Primary Examiner* — Kenneth Rinehart
*Assistant Examiner* — Bao D Nguyen
(74) *Attorney, Agent, or Firm* — Middleton Reutlinger; Chad D. Bruggeman; John F. Salazar

(57) ABSTRACT

A low pressure heater control system. In some embodiments a control is in electrical communication with a sensor having a view of a combustion chamber. The control calculates an average sensor value over each of a plurality of brief sampling periods based on a plurality of readings from the sensor. In some embodiments a reference point that may be at least based in part on an average of a plurality of average optical sensor values from earlier brief sampling periods is calculated and compared against the average optical sensor value from a recent brief sampling period to monitor for an abrupt combustion change. In some embodiments a peak-to-peak optical sensor value is also calculated over each of a plurality of brief sampling periods. In some embodiments the type of fuel being combusted is recognized and/or the fuel level approximated based on measured average and/or peak-to-peak optical sensor values.

19 Claims, 4 Drawing Sheets

LOW PRESSURE HEATER CONTROL SYSTEM

CROSS-REFERENCE TO RELATED APPLICATIONS

This application claims the benefit of U.S. Provisional Application No. 61/079,614, filed Jul. 10, 2008.

BACKGROUND OF THE INVENTION

1. Field of the Invention

The present invention is related generally to a low pressure heater control system and more specifically to an apparatus and method for flame and fuel recognition and analysis for low pressure liquid fueled heaters.

2. Description of Related Art

Low pressure liquid fueled heaters typically include at least a fuel tank, a combustion chamber, a compressor, a fuel nozzle assembly, and an igniter. Compressed air moving through the fuel nozzle assembly creates suction on a fuel line that runs from the fuel nozzle assembly to the fuel tank. The suction draws one of a multitude of usable fuels from the fuel tank into the fuel nozzle assembly and the compressed air delivers the fuel through the nozzle and causes it to be atomized and expelled through the nozzle output and delivered into the combustion chamber in the vicinity of the igniter, where it is ignited. The igniter may be a spark plug, glow plug, hot surface igniter, or the like. The fan typically provides secondary combustion air to the combustion chamber and also serves to discharge the heated air through a discharge end of the combustion chamber.

Optical sensors and other sensors have been used with electronic controls in low pressure liquid fueled heaters to monitor characteristics of a flame burning in a low pressure liquid fueled heater combustion chamber. However, prior art electronic controls have struggled to accurately recognize what fuel is being burned and accurately recognize changes in flame characteristics over the entire range of fuel tank levels.

DETAILED DESCRIPTION

Figure 1:
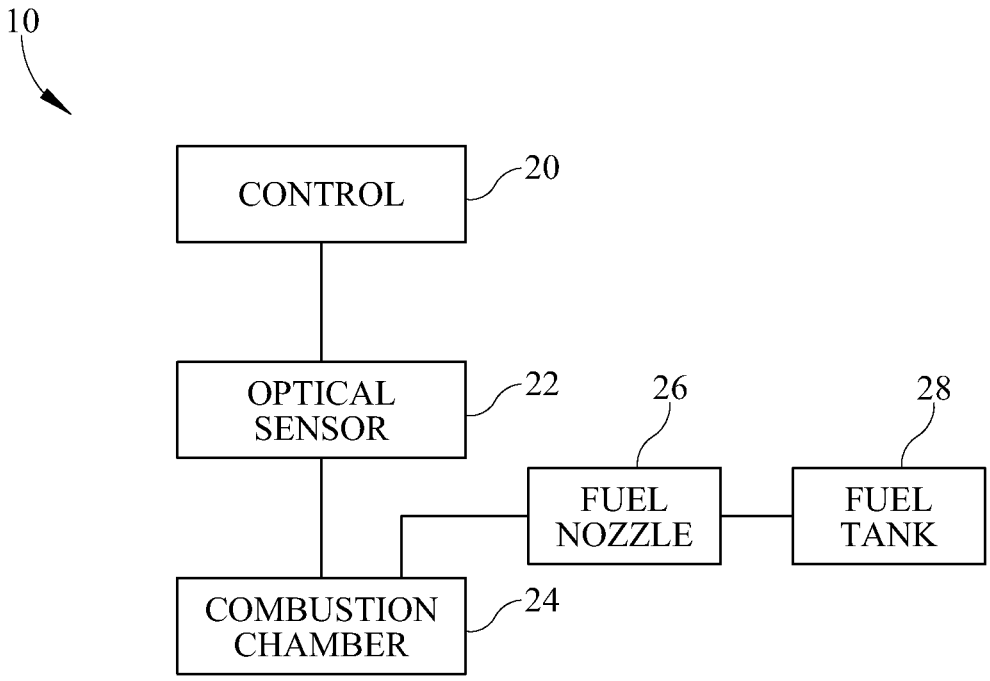
FIG. 1 is a diagram of an embodiment of an apparatus for flame and fuel recognition and analysis for a low pressure portable forced air heater.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific configurations illustrated in the drawings are intended to merely exemplify embodiments of the invention and other alternative configurations are possible.

Figure 2:
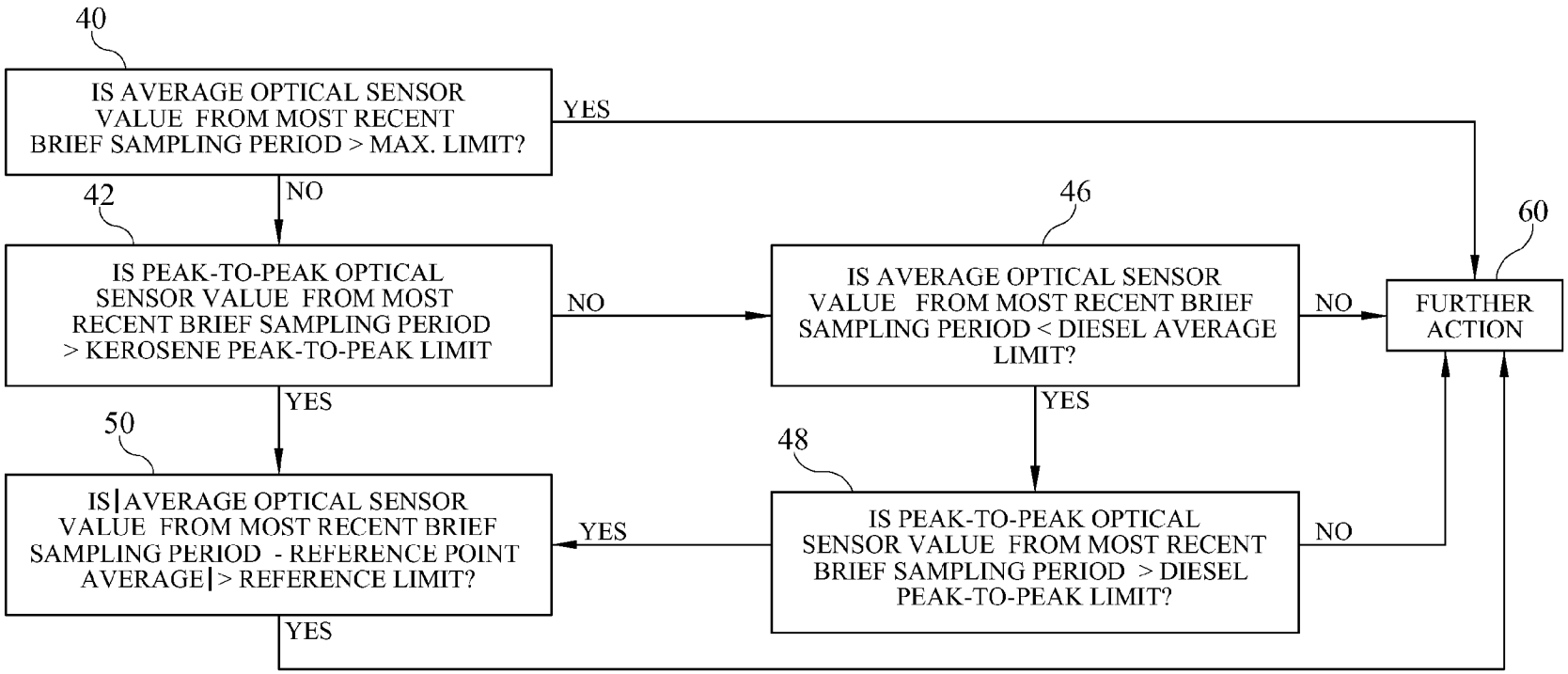
FIG. 2 is a flow chart of an embodiment of a method of flame recognition and analysis for a low pressure portable forced air heater.
Figure 3:
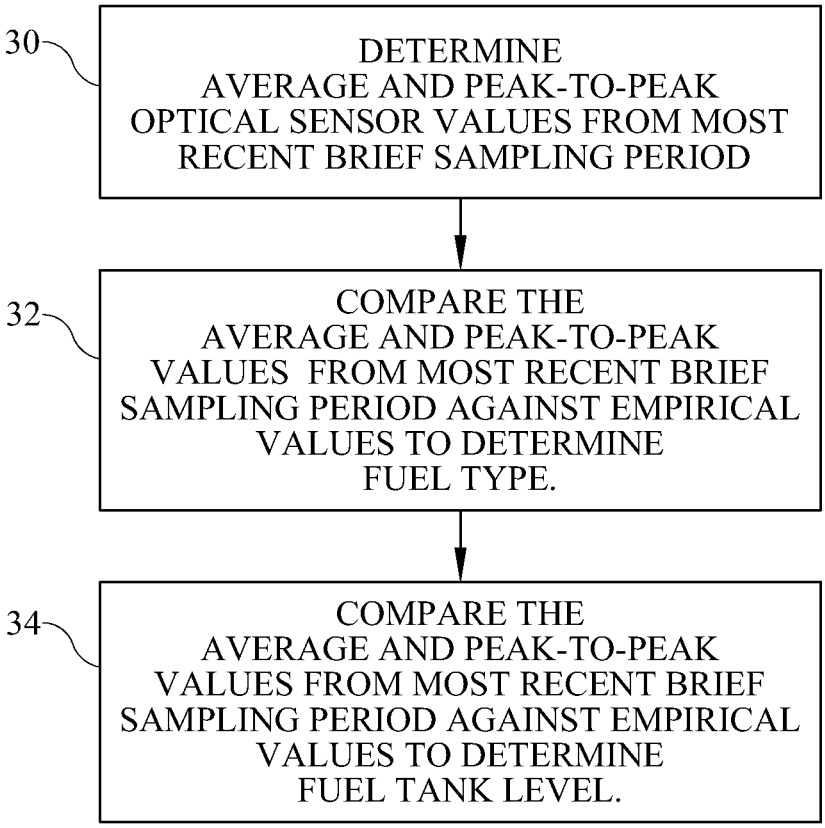
FIG. 3 is a flow chart of an embodiment of a method of fuel recognition and fuel level determination for a low pressure portable forced air heater.

Referring now in detail to the drawings, wherein like numerals indicate like elements throughout the several views, there are shown in FIGS. 1-3 various aspects of a control system for a low pressure liquid fueled heater. In the embodiments described herein the low pressure liquid fueled heater is a low pressure portable forced air heater 10. However, as will become clear with reference to the remainder of the description, the control system for a low pressure liquid fueled heater is not limited to use with low pressure portable forced air heater 10. Rather, the control system may be used with a number of low pressure liquid fueled heaters that are connected to a limited supply of fuel and where the amount of fuel in the fuel tank affects the amount of fuel drawn into the fuel nozzle assembly. Turning to FIG. 1, an electronic controller or control 20 is provided that can comprise in whole or in part, but is not limited to, digital logic, a programmable logic device, a programmed microprocessor, and other logic. In some preferred embodiments control 20 is a programmed microprocessor and has a memory that may be integral with control 20, or may be provided separate from, but in communication with, control 20.

In general, the control system of the various embodiments depicted is designed for detection of various fuel and combustion conditions utilizing static and variable expected sensor values. By utilizing a continuously updated reference point average, abrupt changes in flame characteristics can be substantially diagnosed without common false positive detections or not taking into account 'creep' conditions of flame characteristics common with low pressure fuel and heater systems. By creep conditions it is meant that flame characteristics such as optical patterns or brightness, may vary over time depending on the level of fuel in the tank and other operational parameters. As these flame characteristics modify over time, use of simple static target values for sensors creates possible false positives of error conditions. Thus, it is desirable to keep track of average values for comparison against instantaneous measurements or short cycle sampling periods to determine a differential reference point. This differential reference point or limit can indicate that an instantaneous flame error condition exists, thus taking into account a gradual creep of flame luminosity or other measured property. Further, static values for maximum measured characteristics may also be utilized to determine extremely lean flame conditions, fuel rich flame conditions or no flame conditions. Finally, fuel recognition may be achieved by measurement of various peak to peak sensor measurements as compared against known empirical data which accurately allows the control system of the various embodiments to test and verify out of tolerance conditions as fuel type modifies measured characteristics driving determination of these error conditions.

Thus, the control system of the various embodiments for the present invention utilizes static and continuously updated optical sensor values to verify flame status and condition. In allowing for a continuously modified reference point average, abrupt changes in flame conditions can be accurately detected without false positives. Generally, in one embodiment, average optical values may be utilized and compared against known limit values to determine lean flame conditions. As well, peak to peak optical values can be utilized and compared to known values for varying types of fuel to determine fuel rich conditions. Also, differences between optical sensor values and continuously updated averages can accurately determine abrupt flame condition changes. Abrupt flame condition changes can occur as a result of blocked air inlets and reduced or no airflow to the combustion chamber or fuel leak. These can be accurately diagnosed even with the continuously changing flame characteristic caused in low pressure heater applications as a results of lowering tank conditions.

Control 20 is in electrical communication with an optical sensor 22. Optical sensor 22 is operably positioned to view a flame within a portable forced air heater combustion chamber 24. A fuel nozzle 26 is in communication with a fuel tank 28 and may draw fuel from the fuel tank 28. In some embodiments a hose may place the fuel nozzle 26 in communication with the fuel tank 28. The fuel nozzle 26 is in communication with the combustion chamber 24 and is operably positioned to deliver atomized fuel to the combustion chamber 24. In some embodiments the fuel nozzle 26 may be placed adjacent the input end of the combustion chamber 24 and may be secured to a rear head adjacent the input end of the combustion chamber 24.

Optical sensor 22 can be any type of optical sensor wherein a characteristic of the optical sensor varies in response to changes in a flame and such changes can be monitored by control 20. In some embodiments, the resistance of optical sensor 22 varies in response to changes in flame luminosity. In those and other embodiments control 20 monitors the resistance of optical sensor 22, or monitors an electrical signal that is altered in response to changes in resistance in optical sensor 22. As is known, optical sensor 22 can be provided with a high resistance that decreases as luminosity increases, or vice versa. The remainder of the description will assume an optical sensor 22 with a high resistance that decreases as luminosity increases, although the methods and apparatuses herein described are readily adaptable to the opposing situation, as well as adaptable to various types of optical sensors. Other equivalent types of sensors may also be provided in addition to or in lieu of optical sensor 22. For example, in some embodiments a temperature sensor may be operably positioned to detect temperature changes of a flame within combustion chamber 24. In other embodiments an audio sensor may be operably positioned to detect acoustical changes of a flame within portable forced air heater combustion chamber 24. In other embodiments a flame rectification device may be operably positioned to detect changes in a flame within portable forced air heater combustion chamber 24. In other embodiments a fuel flow sensor that detects changes in fuel flow rate may be positioned at any point between the fuel tank and fuel nozzle of low pressure portable forced air heater 10.

Based on signals received from optical sensor 22, or an equivalent type of sensor, control 20 is able to deduce a number of flame characteristics such as, but not limited to, turbulence and color. Control 20 and optical sensor 22 can be configured so that control 20 can receive and store any practical number of readings from optical sensor 22 every second. In some embodiments, control 20 receives and stores approximately sixty four readings every second. For simplicities sake only, and in no way meant to limit the scope of the present invention, the methods described throughout this description will often be described with the assumption that control 20 is receiving and storing sixty four readings every second from optical sensor 22.

Based on data received from optical sensor 22, control 20 determines the maximum, the minimum, and the average optical sensor reading recorded over a predetermined brief sampling period. Preferably the brief sampling period is approximately every second, although it could be time periods of differing duration or frequency. Again, for simplicities sake only, and not to limit the invention in any way, this brief sampling period will often be referenced as a one second sampling period throughout the remainder of this description.

Figure 4:
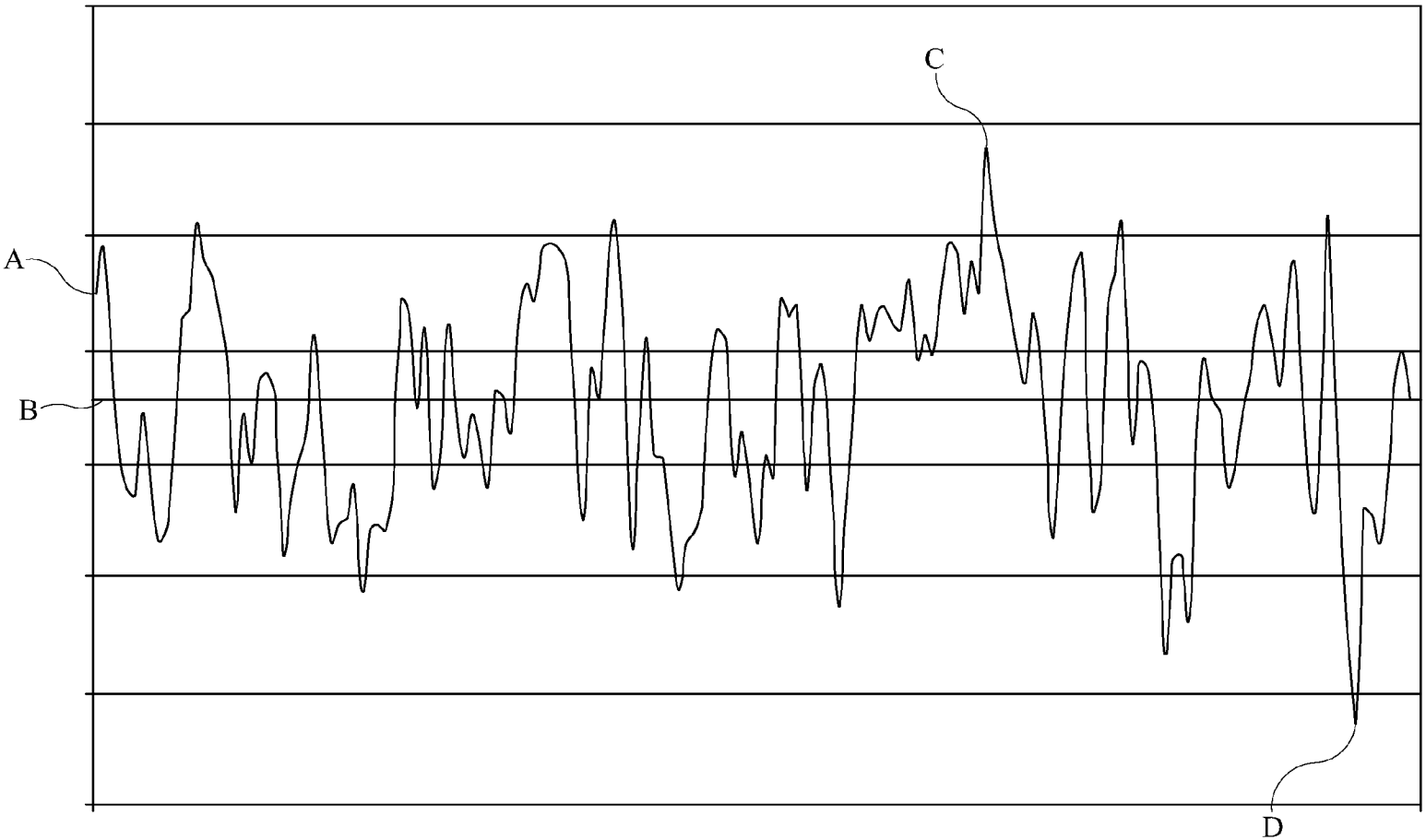
FIG. 4 is a graphical depiction of exemplary optical sensor readings received by a control of a low pressure portable forced air heater over a sampling period and showing an average optical sensor value and a peak-to-peak optical sensor value.

Exemplary raw data received by control 20 over a one second brief sampling period from optical sensor 22, when a flame is present in combustion chamber 24, is depicted generally by waveform A in FIG. 4. With reference to FIG. 4, the maximum optical sensor value for the illustrated one second period is indicated by reference C, the minimum optical sensor value for the illustrated one second period is indicated by reference D, and the average optical sensor value for the illustrated one second period is indicated by line B. Preferably, the difference between the maximum and minimum optical sensor values and the average optical sensor value for each brief sampling period is at least temporarily stored in memory of control 20. This enables each of these values to be utilized in various processes discussed herein. The average optical sensor value indicated by line B is the average of all readings received by control 20 from optical sensor 22 over the brief sampling period shown. However, in some embodiments the average optical sensor value may be an average of less than all readings received by control 20 from optical sensor 22. For example, the control 20 could ignore data points that are statistical outliers. Also, for example, in some embodiments the average optical sensor value may be an average of just all peak values over a brief sampling period (not just the maximum peak value indicated by reference C). In other words, an average of all readings received by control 20 from optical sensor 22 that were preceded by and followed by a reading of a lower value. Similarly, for example, in some embodiments the average optical sensor value may be an average of just all trough values over a brief sampling period (not just the minimum trough value indicated by reference D). In other words, an average of all readings received by control 20 from optical sensor 22 that were preceded by and followed by a reading of a higher value. As will be clear to one skilled in the art, regardless of whether all values, only peak values, or only trough values over the brief sampling period are used in calculating the average optical sensor value, the apparatuses and processes hereinafter discussed are capable of being practiced.

Control 20 also determines a reference point average that is based on an average of a plurality of average optical sensor values from earlier brief sampling periods. The reference point average can be updated in a number of manners and calculated from any amount of average optical sensor values from earlier brief sampling periods. In some embodiments the reference point average is calculated from sixty-four average optical sensor values from sixty-four earlier brief sampling periods. For simplicities sake only, and not to limit the invention in any way, the number of averages from previous brief sampling periods that the reference point average is based on will often be referenced as and assumed to be sixty-four. Also, in some preferred embodiments the reference point average is continuously updating, whereas, for example, it is based on the sixty-four average optical sensor values from the sixty four brief sampling periods immediately preceding the most recently calculated average optical sensor value from the most recent brief sampling period. In other embodiments, the reference point average could only update intermittently. For example, the reference point average could still be an average of sixty-four average optical sensor values from sixty-four earlier brief sampling periods, but only be updated after every sixty-four brief sampling periods or after some other predetermined number of brief sampling periods. Also, as will become clear, in some situations the reference point average could temporarily take on a predetermined static value or could be affected by something other than solely predetermined average optical sensor values from previous brief sampling periods. Again, for simplicities sake only, and not to limit the invention in any way, the reference point average will often be referenced as and assumed to be an average of the sixty-four average optical sensor values from the sixty-four brief sampling periods immediately preceding the most recent brief sampling period throughout the remainder of this description.

The reference point average can be updated in a number of manners and calculated from any amount of average optical sensor values from earlier brief sampling periods. In some embodiments the reference point average is calculated from sixty-four average optical sensor values from sixty-four earlier brief sampling periods.

The diagram of FIG. 3 illustrates an embodiment of a method of fuel recognition and fuel level determination for low pressure portable forced air heater 10. In block 30, the average optical sensor value over the most recent brief sampling period is determined, as is the difference between the maximum and minimum optical sensor values (peak-to-peak value) over the most recent brief sampling period. These values are determined by analysis of the sixty-four readings received by control 20 from optical sensor 22 during the most recent brief sampling period. Preferably, determination of these values occurs after each brief sampling period and the values are used in the various methods described herein.

In block 32, both the peak-to-peak and average optical sensor values from the most recent brief sampling period are compared against stored empirically determined average and peak-to-peak values that correspond to a certain fuel type to determine what fuel the measured average and peak-to-peak optical sensor values correspond with. Any appropriate number of stored empirically determined values can be used and the comparison against the stored empirically determined values can be accomplished using a number of programming methods. In a low pressure liquid fueled heater both the peak-to-peak and average optical sensor values of any given fuel vary as a result of changing levels of fuel in the fuel tank. As the amount of fuel in the fuel tank decreases, the distance between the fuel nozzle assembly and the fuel in the fuel tank increases. Therefore, more of the vacuum that is created in the fuel line is used to lift the fuel from the fuel tank and less fuel is resultantly delivered from the fuel tank to the fuel nozzle assembly. As a result, the combustion characteristics of a fuel in a low pressure liquid fueled heater vary as the amount of fuel in the fuel tank changes. Thus, two different fuels that have distinct peak-to-peak or average optical sensor values when measured at matching fuel tank levels, may have peak-to-peak or average optical sensor values that correspond or substantially correspond when measured at varying fuel tank levels. Therefore, it is desirable to determine what range both the peak-to-peak and average optical sensor values fall within to properly deduce what fuel is being combusted at all fuel tank levels.

For example, in a low pressure portable forced air heater that burns either diesel or kerosene, for a given fuel tank level, the peak-to-peak optical sensor value of kerosene would be higher than and the average optical sensor value of kerosene would be higher than the peak-to-peak and average optical sensor values for diesel at the same given fuel tank level. At certain tank levels the peak-to-peak optical sensor value of kerosene could mimic the peak-to-peak optical sensor value of diesel and at different tank levels the average optical sensor value of kerosene could likewise mimic the average optical sensor value of diesel. However, by analyzing both the peak-to-peak and average optical sensor values during a brief sampling period and comparing them to stored empirically determined peak-to-peak and average values, it can be accurately determined what fuel is currently being used at all fuel tank levels.

In addition to determining what fuel is being used, the average and peak-to-peak optical sensor values from the most recent brief sampling period can also provide an indirect indication of fuel tank level. In block 34 of FIG. 3, both the peak-to-peak and average optical sensor values from the most recent brief sampling period are compared against stored empirically determined average and peak-to-peak values that correspond with fuel tank levels of a given low pressure portable forced air heater for a given fuel to determine what range of empirical values both measured optical sensor values are within and resultantly, what the approximate fuel tank level is. Different empirically determined average and peak-to-peak values correspond with different fuel tank levels of a given low pressure liquid fueled heater burning a given fuel as a result of the variation in combustion characteristics that occur as the amount of fuel in the fuel tank changes. Therefore, through sufficient testing of a given low pressure liquid fueled heater it can be determined what average and/or peak-to-peak values correspond to what fuel level for a given fuel. In other embodiments only the peak-to-peak or only the average optical sensor value from the most recent brief sampling period could be compared against respective values that correspond with fuel tank levels of a given low pressure portable forced air heater for a given fuel to determine the approximate fuel level.

Control 20 may interact with low pressure portable forced air heater 10 in a number of ways dependent upon the approximated determination of fuel tank level. Control 20 may cause the approximated fuel tank level to be communicated to a user in a number of ways. For example, control could display the fuel tank level visually, or cause a warning light, a warning sound, or both, to be activated if the fuel level falls below a predetermined amount. Additionally or alternatively, control 20 could adjust or shut down one or more constituent parts of low pressure portable forced air heater 10. For example, control 20 could cause the delivery rate of fuel to be adjusted via a solenoid valve, or cause the speed of the compressor, fan, or both to be altered, in order to adjust low pressure portable forced air heater 10 appropriately for the current fuel tank level.

Alternatively, the reference point average or another value that is an average of a plurality of previously determined average optical sensor values from previous brief sampling periods may be used in lieu of the average optical sensor value from the most recent brief sampling period in determining fuel type or fuel tank level. Also, a value that is an average of a plurality of previously determined peak-to-peak optical sensor values from previous brief sampling periods may be used in lieu of the peak-to-peak value from the most recent brief sampling period in determining fuel type or fuel tank level.

The diagram of FIG. 2 illustrates an embodiment of the flame recognition and analysis process undertaken by control 20 for a low pressure portable forced air heater 10 that burns kerosene and diesel. This flame analysis process is preferably performed by control 20 after every brief sampling period and after the peak-to-peak and average optical sensor values have been determined for the most recent brief sampling period as discussed in block 30. All predetermined values used in the flame recognition and analysis process may be unique to the particular fuel being used and to the characteristics of the low pressure portable forced air heater being used and are preferably based on empirically determined data. As will become apparent, the predetermined values used may also be unique to the approximated fuel tank level, the stage of the flame analysis process, or other factors.

In block 40 it is determined whether the average optical sensor value from the most recent brief sampling period is greater than a predetermined maximum value, max limit. Max limit is set so that an average optical sensor value from the most recent brief sampling period that exceeds it would indicate that no flame, or an extremely fuel lean flame, is present in combustion chamber 24. If it is determined no flame is present, then the process proceeds to further action block 60, where control 20 causes some type of further action to be taken. For example, control 20 could cause low pressure portable forced air heater 10, or one or more of its constituent parts, to shut down. Alternatively, control 20 can store this occurrence to memory and require one or more additional confirmations via the flame analysis process to confirm that no flame, or an extremely fuel lean flame is present after one or more additional brief sampling periods. Additionally or alternatively, control 20 could adjust or shut down one or more constituent parts of the low pressure portable forced air heater 10. For example, control 20 could cause the delivery rate of fuel to be adjusted via a solenoid valve, or cause the speed of the compressor, fan, or both to be altered, in an attempt to remedy the fuel lean situation. Additionally or alternatively, control 20 could perform the fuel determination process of block 32 to ensure that the fuel on which the predetermined value is based is indeed the fuel currently being combusted. If it is determined that the average optical sensor value from the most recent brief sampling period is not greater than max limit, then the process proceeds to block 42.

In block 42 it is determined whether the calculated peak-to-peak optical sensor value from the most recent brief sampling period is greater than a predetermined value, kerosene peak-to-peak limit. Kerosene peak-to-peak limit is set so that a peak-to-peak value optical sensor value from the most recent brief sampling period that does not exceed it would indicate that a fuel rich situation is potentially present in combustion chamber 24. In this embodiment, this value is preferably based on the minimal peak-to-peak value generated by optical sensor over a brief sampling period when kerosene is safely being burned. If the peak-to-peak optical sensor value from the most recent brief sampling period is greater than the kerosene peak-to-peak limit, then the process proceeds to block 50. However, if the peak-to-peak optical sensor value from the most recent brief sampling period is less than the kerosene peak-to-peak limit, then the process preferably proceeds to block 46 to further determine if a fuel rich situation is present.

In block 46 it is determined whether the average optical sensor value from the most recent brief sampling period is less than a predetermined value, diesel average limit. Diesel average limit is set so that an average optical sensor value from the most recent brief sampling period that exceeds it would also indicate that a fuel rich situation is potentially present. In this embodiment, this value is preferably based on the maximum average value generated by optical sensor over a brief sampling period when diesel is safely being burned. If the average value from the most recent brief sampling period is not less than the predetermined static value, then a fuel rich situation is likely present and the process proceeds to further action block 60, where control 20 causes some type of further action to be taken. Control 20 could cause portable forced air heater 10, or one or more of its constituent parts, to shut down. Additionally or alternatively, control 20 could store this to memory and require one or more additional confirmations via the flame analysis process to confirm that a fuel rich situation is present after one or more additional brief sampling periods. Additionally or alternatively, control 20 could perform the fuel determination process of block 32 to ensure that the fuel on which the predetermined static value is based is indeed the fuel currently being combusted. Additionally or alternatively, control 20 could adjust or shut down one or more constituent parts of low pressure portable forced air heater 10. For example, control 20 could cause the delivery rate of fuel to be adjusted via a solenoid valve, or cause the speed of the compressor, fan, or both to be altered, in an attempt to remedy the fuel rich situation. However, if the average optical sensor value from the most recent brief sampling period is less than or equal to the predetermined value, then the process proceeds to block 48 to further ensure a fuel rich situation is not present.

In block 48 it is determined whether the peak-to-peak optical sensor value from the most recent brief sampling period is greater than a predetermined value, diesel peak-to-peak limit. Diesel peak-to-peak limit is less than the kerosene peak-to-peak limit of block 42 and is set so that a peak-to-peak optical sensor value from the most recent brief sampling period that does not exceed it would indicate that a fuel rich situation is likely present in combustion chamber 24. In this embodiment, this value is preferably based on the minimal peak-to-peak value generated by optical sensor over a sampling period when diesel is safely being burned. If the peak-to-peak optical sensor value from the most recent brief sampling period is not greater than the diesel peak-to-peak limit, then a fuel rich situation is likely present and the process proceeds to further action block 60, where control 20 causes some type of further action to be taken. For example, control 20 could cause low pressure portable forced air heater 10, or one or more of its constituent parts, to shut down. Additionally or alternatively, control 20 can store this to memory and require one or more additional confirmations via the flame analysis process to confirm that a fuel rich situation is present after one or more additional brief sampling periods. Additionally or alternatively, control 20 could perform the fuel determination process of block 32 to ensure that the fuel on which the predetermined static value is based is indeed the fuel currently being combusted. Additionally or alternatively, control 20 could adjust or shut down one or more constituent parts of low pressure portable forced air heater 10. For example, control 20 could cause the delivery rate of fuel to be adjusted via a solenoid valve, or cause the speed of the compressor, fan, or both to be altered, in an attempt to remedy the fuel rich situation. However, if the peak-to-peak value is greater than or equal to the diesel peak-to-peak limit, then the process proceeds to block 50.

In block 50 it is determined whether the absolute difference between the average optical sensor value from the most recent brief sampling period and the continuously updated current reference point average is greater than a predetermined static value, reference limit. The static value reference limit is set so that an absolute difference between the average optical sensor value from the most recent brief sampling period and the current reference point average that exceeds the reference limit would indicate an abrupt change in flame conditions, which would be indicative of problems with the low pressure portable forced air heater. The abrupt change could be caused by a number of issues, such as, but not limited to, blocked inlet, blocked outlet, fan loss, a bypass in the regulator, and a fuel leak. Use of the continuously updated reference point average instead of a static value allows the reference limit to be a smaller number since the reference point average will vary appropriately as the amount of fuel in the fuel tank changes, whereas a static value would not. Thus, the control system of the present embodiment utilizes a much narrower window for error condition determination while reducing false positive condition alerts. Thus, erroneous findings of an abrupt change at high or low fuel levels and/or use of a large reference limit that may miss many abrupt changes can be prevented through use of the updated reference point average. In some embodiments, the reference limit is set such that the same value can be used for any fuel. Obviously, the analysis of block 50 could be performed independently of other parts of the flame recognition and analysis process to only monitor a flame for abrupt changes. Also, the analysis of block 50 could be performed with only certain other parts of the flame recognition and analysis process, with additions to the process, or with another process altogether.

If the absolute difference between the average optical sensor value from the most recent brief sampling period and the current reference point is greater than the reference limit, then the process proceeds to further action block 60, where control 20 causes some type of further action to be taken. In some embodiments, control 20 causes low pressure portable forced air heater 10, or one or more of its constituent parts, to immediately shut down. Alternatively, control 20 can store this occurrence to memory and require one or more confirmations via the flame analysis process, the analysis of block 50, or other process to confirm that an abrupt change has occurred and still persists after one or more additional brief sampling periods. During these one or more confirmations, control 20 could cause the reference point average to temporarily cease updating in order to prevent its value from being affected by the potentially tainted average optical sensor value from the additional brief sampling periods. Additionally or alternatively, control 20 could adjust one or more constituent parts of low pressure portable forced air heater 10. For example, control 20 could cause the delivery rate of fuel to be adjusted via a solenoid valve, or cause the speed of the compressor, fan, or both to be altered, in order to attempt to remedy the situation.

However, if the difference between the average optical sensor value from the most recent brief sampling period and the current reference point average is not greater than the reference limit, then the flame analysis process, or the analysis of block 50 can be restarted utilizing average and peak-to-peak optical sensor values from a new brief sampling period and possibly a reference point average that incorporates the most recently determined average optical sensor value. Prior to restarting the flame recognition and analysis process or other process, control 20 could also perform the fuel recognition process of block 32 with values from a new brief sampling period to reevaluate the fuel type and may choose to adjust some or all of the predetermined values based on the fuel type determination. Also, control 20 could perform the fuel tank level determination process of block 34 and likewise may choose to adjust some or all of the predetermined values based on the fuel tank level.

During the initial sixty-four brief sampling periods the reference point average will not be able to be calculated as the average of sixty-four average optical sensor values from sixty-four preceding brief sampling periods, since sixty-four brief sampling periods have yet to occur. Moreover, immediately after a new fuel type has been detected by control 20, a reference point average for that fuel will not be available since sixty-four brief sampling periods for that fuel have yet to occur. In the interim period before sixty-four brief sampling periods occur, control 20 could simply not run the abrupt change in flame process of block 50 or temporarily calculate the reference point average with less than sixty-four averages or a certain amount of available readings received from optical sensor 22. Control 20 could also temporarily utilize one of a multitude of predetermined reference point averages. For example, control 20 could temporarily use a predetermined static reference point average that typically corresponds to the fuel type being used and the current approximated fuel tank level. Also, control 20 could temporarily increase the reference limit if desired. In some preferred embodiments, the flame analysis process of block 50 is not run until nine brief sampling periods have occurred, at which point the reference point average would consist of the eight preceding average optical sensor values from the eight preceding brief sampling periods. In those embodiments, the flame analysis process of block 50 will continue to run and the reference point average will consist of an average of the average optical sensor values from the brief sampling periods preceding the most recent brief sampling period, until sixty-five brief sampling periods have occurred, at which point the reference point will consist of the average of sixty-four average optical sensor values from sixty-four preceding brief sampling periods.

The foregoing description of structures and methods has been presented for purposes of illustration. It is not intended to be exhaustive or to limit the invention to the precise steps and/or forms disclosed, and obviously many modifications and variations are possible in light of the above teaching. It is understood that while certain forms of a low pressure heater control system have been illustrated and described, it is not limited thereto except insofar as such limitations are included in the following claims and allowable functional equivalents thereof.

We claim:

1. A low pressure liquid fueled heater having a control system, comprising:

a fuel nozzle;

a combustion chamber operably positioned to receive output from said fuel nozzle;

an optical sensor operably positioned to view within said combustion chamber;

wherein characteristics of said optical sensor vary in response to changes in a flame that may be present within said combustion chamber;

a control in electrical communication with said optical sensor;

wherein said control determines an average optical sensor value during each of a plurality of brief sampling periods;

wherein said average optical sensor value is calculated from a plurality of readings received from said optical sensor during each of said brief sampling periods; and wherein said control determines a reference point average that is an average of a plurality of previously determined said average optical sensor value;

wherein said control alters at least one characteristic of said low pressure liquid fueled heater if the absolute difference between said recently determined average optical sensor value and said reference point average is greater than a predetermined reference limit, thereby indicating an abrupt change; and a solenoid valve in communication with said fuel nozzle, wherein said control causes said solenoid valve to be adjusted when the absolute difference between said recently determined average optical sensor value and said reference point average is greater than said predetermined reference.

2. The low pressure liquid fueled heater of claim 1, wherein said control determines a peak-to-peak optical sensor value over each of said brief sampling periods based on said plurality of readings received from said optical sensor during each of said brief sampling periods and wherein said predetermined reference limit is determined at least in part by comparing said recently determined average optical sensor value and a recently determined said peak-to-peak optical sensor value to empirically determined average and peak-to-peak values.

3. The low pressure liquid fueled heater of claim 1, wherein said control determines a plurality of peak-to-peak optical sensor values over a plurality of said brief sampling periods based on said plurality of readings received from said optical sensor during each of said brief sampling periods and wherein said predetermined reference limit is determined at least in part by comparing both an average of a plurality of said average optical sensor values and an average of a plurality of said peak-to-peak optical sensor values to empirically determined average and peak-to-peak values.

4. The low pressure liquid fueled heater of claim 3, wherein said control causes at least one constituent part of said low pressure liquid fueled heater to shut down if the absolute difference between said recently determined average optical sensor value and said reference point average is greater than said predetermined reference limit.

5. The low pressure liquid fueled heater of claim 4, wherein said average optical sensor value is calculated from all of said readings received from said optical sensor during each of said brief sampling periods.

6. The low pressure liquid fueled heater of claim 4, wherein said average optical sensor value is calculated from a plurality of peak readings of said readings received from said optical sensor during each of said brief sampling periods.

7. The low pressure liquid fueled heater of claim 1, wherein said control calculates at least one more said average optical sensor value over at least one more said brief sampling period while maintaining said reference point average, and wherein said control shuts down at least one constituent part of said low pressure liquid fueled heater if the absolute difference between said reference point average and said at least one more average optical sensor value is greater than said predetermined reference limit.

8. A low pressure liquid fueled heater having a control system, comprising:

a fuel tank;

a fuel nozzle in communication with said fuel tank;

a combustion chamber operably positioned to receive output from said fuel nozzle;

a sensor operably positioned to view within said combustion chamber;

wherein characteristics of said sensor vary in response to changes in a flame that may be present within said combustion chamber;

a control in electrical communication with said sensor;

wherein said control determines an average sensor value and a peak-to-peak sensor value during each of a plurality of brief sampling periods;

wherein said average sensor value and said peak-to-peak sensor value are calculated from a plurality of readings received from said sensor during each of said brief sampling periods;

wherein said control determines what fuel is being combusted within said combustion chamber by comparing at least one previously determined said average sensor value and at least one previously determined said peak-to-peak sensor value against empirically determined values;

wherein said control determines a reference point average that is an average of a plurality of previously determined said average sensor values;

wherein said control alters at least one characteristic of said low pressure liquid fueled heater if the absolute difference between at least one average sensor value and said reference point average is greater than a predetermined reference limit;

wherein said predetermined reference limit is based at least partially on said determination of what fuel is being combusted within said combustion chamber; and wherein said control approximates a level of fuel in said fuel tank by comparing at least one previously determined said average sensor value and at least one said previously determined peak-to-peak sensor value against at least one empirically determined value that corresponds to a given fuel tank level for a given fuel.

9. The low pressure liquid fueled heater of claim 8, wherein said predetermined reference limit is based at least partially on said level of fuel.

10. The low pressure liquid fueled heater of claim 8, wherein said control shuts down at least one constituent part of said low pressure liquid fueled heater when said level of fuel in said fuel tank falls below one or more predetermined levels.

11. The low pressure liquid fueled heater of claim 8, wherein said control alters at least one characteristic of said low pressure liquid fueled heater when said level of fuel in said fuel tank falls below one or more predetermined levels.

12. The low pressure liquid fueled heater of claim 11, wherein said control causes said level of fuel in said fuel tank to be communicated to a user.

13. The low pressure liquid fueled heater of claim 8, wherein said sensor is a temperature sensor.

14. A low pressure liquid fueled heater, comprising:

a fuel tank;

a fuel nozzle in communication with said fuel tank;

a combustion chamber operably positioned to receive output from said fuel nozzle;

an optical sensor operably positioned to view within said combustion chamber;

wherein characteristics of said optical sensor vary in response to optical changes within said combustion chamber;

a control in electrical communication with said optical sensor;

wherein said control determines an average optical sensor value and a peak-to-peak optical sensor value during each of a plurality of brief sampling periods;

wherein said average optical sensor value and said peak-to-peak optical sensor value are calculated from a plurality of readings received from said optical sensor during each of said brief sampling periods;

wherein said control approximates a level of fuel in said fuel tank by comparing at least one of said average optical sensor value and said peak-to-peak optical sensor value against at least one empirically determined value that corresponds to a given fuel tank level for a given fuel; and wherein said control determines what fuel is being combusted within said combustion chamber by comparing at least one said average optical sensor value and at least one said peak-to-peak optical sensor value against empirically determined values that correspond to a given fuel.

15. The low pressure liquid fueled heater of claim 14, wherein said control alters at least one characteristic of said low pressure liquid fueled heater when said fuel level falls below a predetermined level.

16. The low pressure liquid fueled heater of claim 14, wherein said control causes said fuel level to be communicated to a user.

17. The low pressure liquid fueled heater of claim 16, wherein said control compares said average optical sensor value to a reference point average that is an average of a plurality of previously determined said average optical sensor value; and wherein said control alters at least one characteristic of said low pressure liquid fueled heater when said comparison indicates an abrupt change.

18. The low pressure liquid fueled heater of claim 17, wherein said average optical sensor value and said reference point average are compared to a predetermined reference limit that is based at least partially on determination of what fuel is being combusted within said combustion chamber.

19. A low pressure liquid fueled heater having a control system, comprising:

a fuel tank;

a fuel nozzle in communication with said fuel tank;

a combustion chamber operably positioned to receive output from said fuel nozzle;

a sensor operably positioned to view within said combustion chamber;

wherein characteristics of said sensor vary in response to changes in a flame that may be present within said combustion chamber;

a control in electrical communication with said sensor;

wherein said control determines an average sensor value and a peak-to-peak sensor value during each of a plurality of brief sampling periods;

wherein said average sensor value and said peak-to-peak sensor value are calculated from a plurality of readings received from said sensor during each of said brief sampling periods;

wherein said control determines what fuel is being combusted within said combustion chamber by comparing at least one previously determined said average sensor value and at least one previously determined said peak-to-peak sensor value against empirically determined values;

wherein said control determines a reference point average that is an average of a plurality of previously determined said average sensor values;

wherein said control alters at least one characteristic of said low pressure liquid fueled heater if the absolute difference between at least one average sensor value and said reference point average is greater than a predetermined reference limit;

wherein said predetermined reference limit is based at least partially on said determination of what fuel is being combusted within said combustion chamber; and wherein said sensor is a temperature sensor.

* * * * *